US010472752B2

(12) United States Patent
Imano et al.

(10) Patent No.: US 10,472,752 B2
(45) Date of Patent: Nov. 12, 2019

(54) SEWING MACHINE

(71) Applicant: JUKI CORPORATION, Tama-shi, Tokyo (JP)

(72) Inventors: Takashi Imano, Tama (JP); Junichi Yoshida, Tama (JP); Toshiki Sugiyama, Tama (JP)

(73) Assignee: JUKI CORPORATION, Tokyo (JP)

( * ) Notice: Subject to any disclaimer, the term of this patent is extended or adjusted under 35 U.S.C. 154(b) by 132 days.

(21) Appl. No.: 15/863,015

(22) Filed: Jan. 5, 2018

(65) Prior Publication Data

US 2018/0195220 A1 Jul. 12, 2018

(30) Foreign Application Priority Data

Jan. 6, 2017 (JP) ..... 2017-001102

(51) Int. Cl.

| | |
|---|---|
| ***D05B 19/14*** | (2006.01) |
| ***D05B 29/08*** | (2006.01) |
| ***D05B 37/06*** | (2006.01) |
| ***D05B 37/08*** | (2006.01) |
| ***D05B 65/00*** | (2006.01) |
| ***D05B 69/06*** | (2006.01) |

(Continued)

(52) U.S. Cl.

CPC ..... *D05B 19/14* (2013.01); *D05B 19/006* (2013.01); *D05B 29/08* (2013.01); *D05B 37/06* (2013.01); *D05B 37/08* (2013.01); *D05B 65/00* (2013.01); *D05B 69/06* (2013.01); *D05B 69/10* (2013.01); *D05B 69/18* (2013.01)

(58) Field of Classification Search

CPC . D05B 9/14; D05B 9/006; D05B 9/16; D05B 29/08; D05B 37/06; D05B 37/08; D05B 65/00; D05B 69/00; D05B 69/06; D05B 69/10; D05B 69/18; D05B 69/20; D05B 69/28; D05B 69/36

See application file for complete search history.

(56) References Cited

U.S. PATENT DOCUMENTS 4,503,374 A * 3/1985 Sakano ..... G01P 3/489 318/561
6,167,824 B1 * 1/2001 Tomita ..... D05B 19/16 112/102.5

(Continued)

FOREIGN PATENT DOCUMENTS

JP 2008073157 A * 4/2008
JP 2010146266 A * 7/2010
JP 4724938 B2 7/2011

*Primary Examiner* — Ismael Izaguirre
(74) *Attorney, Agent, or Firm* — Drinker Biddle & Reath LLP

(57) ABSTRACT

A sewing machine including a detection portion that detects a movement amount of a workpiece, a sewing machine motor that serves as a driving source for vertical movement of a needle bar, and a control device that controls the sewing machine motor based on the detection result by the detection portion and performs control to maintain a constant stitch pitch. The control device lengthens a period for obtaining an output of the detection portion when the movement amount of the workpiece per unit time based on the detection result by the detection portion is decreased, and shortens the period for obtaining the output of the detection portion when the movement amount of the workpiece per unit time based on the detection result by the detection portion is increased.

3 Claims, 4 Drawing Sheets

(51) Int. Cl.

| | |
|---|---|
| ***D05B 69/10*** | (2006.01) |
| ***D05B 69/18*** | (2006.01) |
| ***D05B 19/00*** | (2006.01) |

(56) References Cited

U.S. PATENT DOCUMENTS

| | | | | |
|---|---|---|---|---|
| 8,217,900 | B1 * | 7/2012 | Bowen | A61F 4/00<br>345/168 |
| 2007/0272136 | A1 * | 11/2007 | Shimizu | D05B 11/00<br>112/2 |
| 2009/0205549 | A1 * | 8/2009 | Hirose | D05B 19/16<br>112/470.04 |
| 2010/0031860 | A1 * | 2/2010 | Shimizu | D05B 27/20<br>112/221 |

* cited by examiner

SEWING MACHINE

CROSS-REFERENCE TO RELATED APPLICATION

The present application claims the benefit of priority of Japanese Patent Applications No. 2017-001102, filed on Jan. 6, 2017, the disclosure of which is incorporated herein by reference.

TECHNICAL FIELD

The present invention relates to a sewing machine that performs sewing at a constant stitch pitch.

BACKGROUND ART

A sewing machine is known which maintains a stitch pitch to be constant by acquiring a movement amount of a workpiece on a throat plate by an optical sensor fixedly mounted on a frame of the sewing machine to control a rotation speed of a sewing machine motor such that a stitch point is made with a constant movement amount, (refer to Japanese Patent Registration No. 4724938).

However, in the sewing machine of the related art, a control device accesses the optical sensor for detecting the movement amount of the workpiece at a constant sampling period to obtain the movement amount.

For example, in a case of a sensor with a setting ability of $\alpha$ [μm], one pulse is counted each time the movement amount $\alpha$ [μm] is detected, but when the control device accesses the sensor at a constant sampling period, a large number of pulses are received since the movement amount is large when the workpiece is fed fast, and a small number of pulses are received since the movement amount is small when the workpiece is fed slowly.

Meanwhile, there is a case where noise is generated during detection of a sensor or access by the control device, and when a large number of pulses are received by a single access by the control device, the influence of noise is decreased, and when a small number of pulses are received by a single access, the influence of noise increases.

In other words, when the workpiece is fed slowly, there is a concern that the detection accuracy of the movement amount of the workpiece deteriorates.

SUMMARY OF THE INVENTION

The invention aims at improving the detection accuracy of a movement amount of a workpiece, and has the following features (1) to (3).

(1) A sewing machine comprising:

a detection portion that detects a movement amount of a workpiece;

a sewing machine motor that serves as a driving source for vertical movement of a needle bar; and a control device that controls the sewing machine motor based on the detection result by the detection portion and performs control to maintain a constant stitch pitch, wherein the control device lengthens a period for obtaining an output of the detection portion when the movement amount of the workpiece per unit time based on the detection result by the detection portion is decreased, and shortens the period for obtaining the output of the detection portion when the movement amount of the workpiece per unit time based on the detection result by the detection portion is increased.

(2) The sewing machine according to (1), wherein free motion sewing is performed by manually moving the workpiece with respect to a position of a stitch point of the sewing machine.

(3) The sewing machine according to (1), wherein free motion sewing is performed by manually moving the sewing machine with respect to the workpiece.

According to the invention, by having any one of the features (1) to (3), since the control device lengthens the period for obtaining the output of the detection portion as the movement amount of the workpiece based on the detection result by the detection portion is decreased, when the cloth feeding amount is small, it is possible to increase the number of signals from the detection portion that are received in one period, and to achieve improvement of the detection accuracy by reducing the influence of noise.

BRIEF DESCRIPTION OF DRAWINGS

FIGS. 4A and 4B are explanatory views illustrating a detection state of a sensor when a period for obtaining an output of each sensor is constant, wherein FIG. 4A illustrates a case where a cloth feeding amount is small, and FIG. 4B illustrates a case where the cloth feeding amount is large.

DETAILED DESCRIPTION

Outline of Embodiment of Invention

Figure 1:
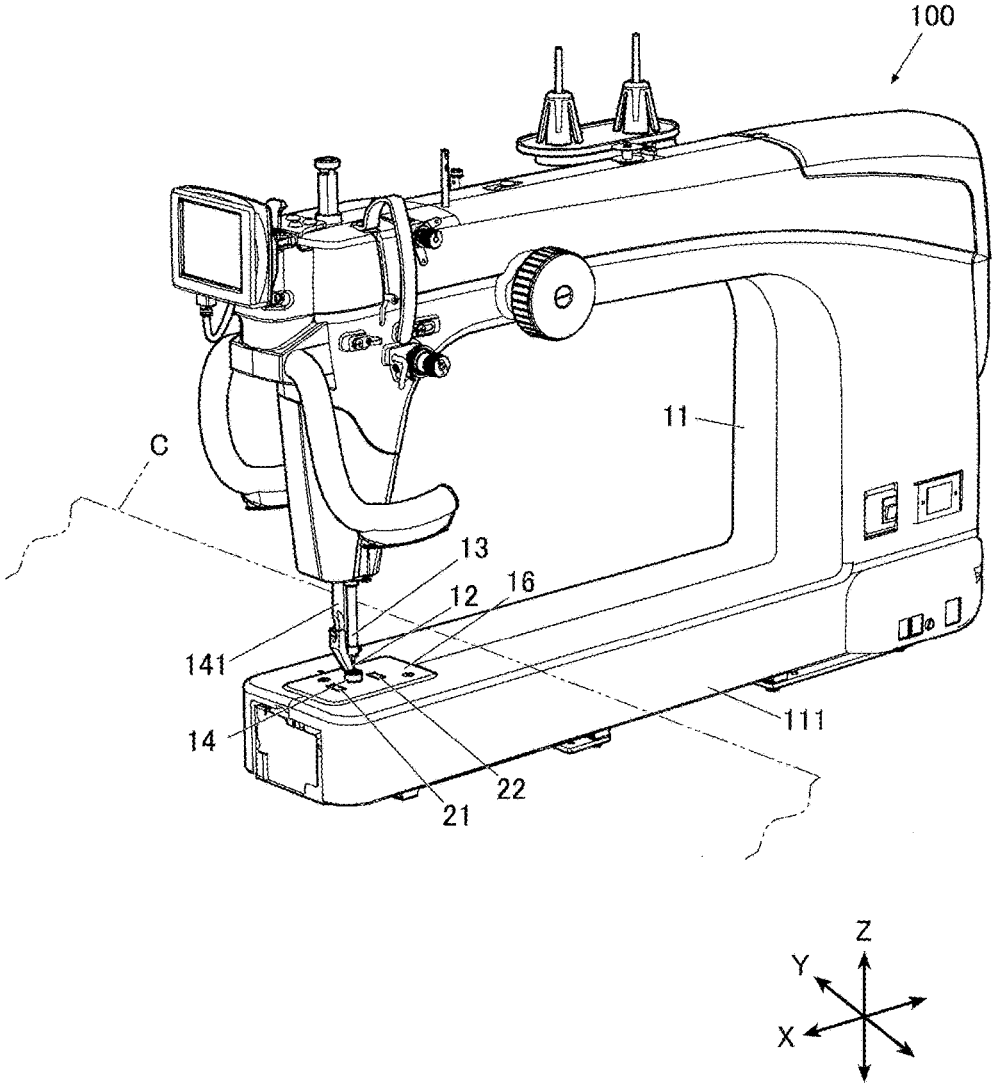
FIG. 1 is a perspective view of a sewing machine according to an embodiment of the invention.
Figure 2:
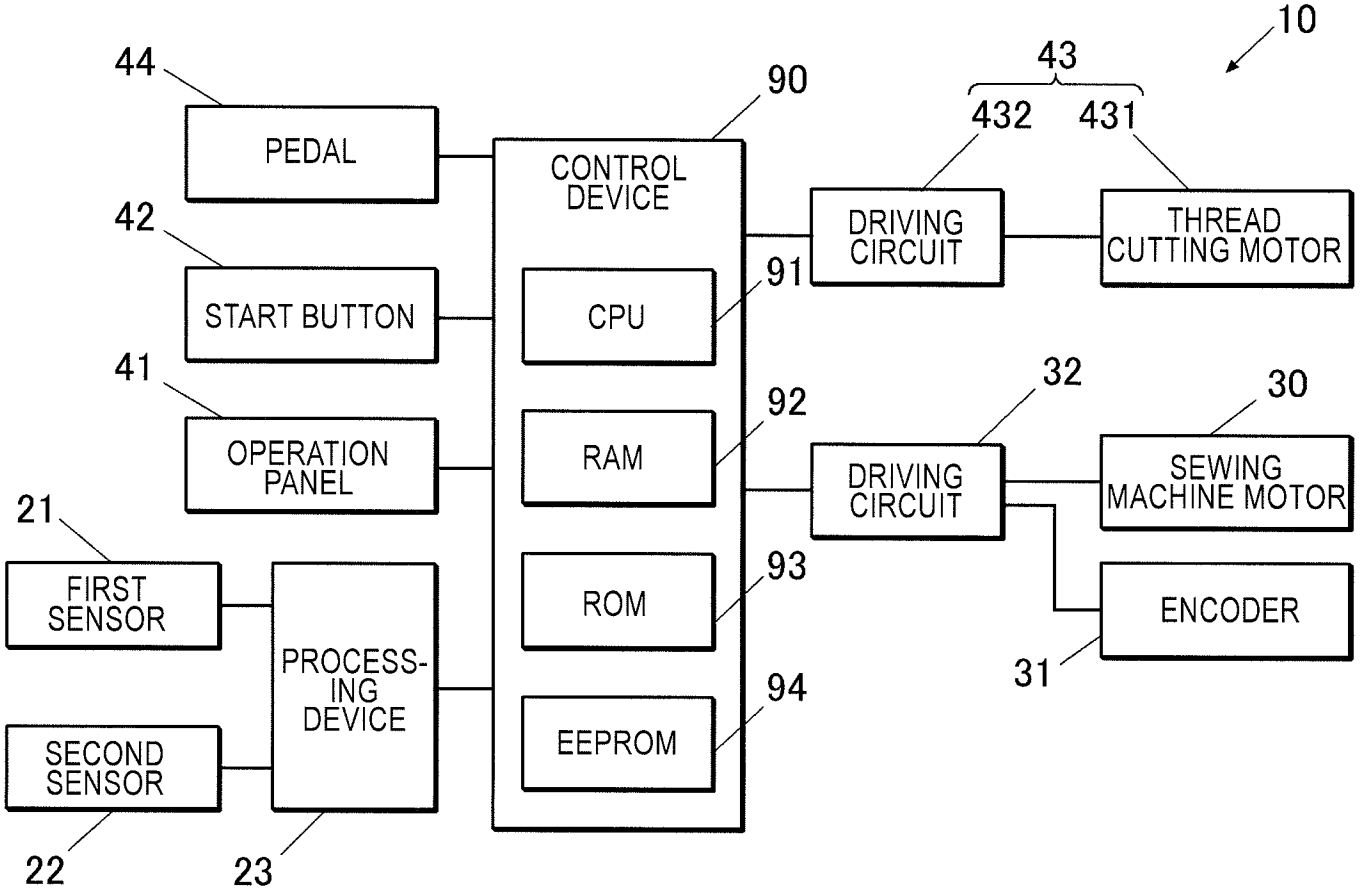
FIG. 2 is a block diagram illustrating a control system of the sewing machine.

Hereinafter, a sewing machine according to the invention will be described with reference to the drawings. FIG. 1 is a perspective view of a sewing machine 100, and FIG. 2 is a block diagram illustrating a control system of the sewing machine 100.

In addition, the sewing machine 100 according to the embodiment is a sewing machine that can perform so-called free motion sewing, in which an operator freely moves a workpiece by a manual operation and performs sewing on cloth while relatively positioning cloth C with respect to a position of a stitch point.

In addition, in the embodiment, since the illustration of a holding base and the description of a structure thereof are the same as those of a well-known holding base, the illustration and the description thereof will be omitted.

The sewing machine 100 includes: a needle bar vertical moving mechanism for vertically moving a needle bar 13 that holds a needle 12 at a lower end portion thereof; a shuttle mechanism for catching a needle thread passed through the needle 12 and for entwining the needle thread with a bobbin thread; a thread take-up lever mechanism for forming a knot by drawing up the needle thread; a thread tensioner for applying a predetermined tension to the needle thread; a sewing machine frame 11 for accommodating or holding these members; and a control device 90 that serves as a control portion which performs operation control of each portion.

Since the needle bar vertical moving mechanism, the shuttle mechanism, the thread take-up lever mechanism, and the thread tensioner are the same as known configurations in the sewing machine, the detailed explanation thereof will be omitted.

The sewing machine frame 11 is configured with a bed portion 111 which is positioned in a lower part of a sewing machine main body; an upright drum portion which stands from one end portion of the bed portion; and an arm portion which extends in the same direction as the bed portion from the upright drum portion.

In the following description, a direction which is a horizontal direction and is along a longitudinal direction of a bed portion 111 is an X axis direction, a direction which is a horizontal direction and is orthogonal to the X axis direction is a Y axis direction, and a perpendicularly vertical direction which is orthogonal to the X axis direction and the Y axis direction is a Z axis direction.

In addition, the sewing machine 100 is provided with a middle presser foot 14 for pressing the cloth C so as to smoothly escape from the cloth C when the needle 12 is lifted up. The middle presser foot 14 is supported in the lower end portion of a middle presser foot rod 141. In addition, the middle presser foot 14 is a small frame body capable of loosely inserting the needle 12 therein, obtains power from a sewing machine motor 30 (refer to FIG. 2) which is a driving source for vertically moving the needle bar 13 via a known transmission mechanism, and vertically moves with an amplitude smaller than that of the needle bar 13. In addition, a phase of the middle presser foot 14 is shifted from the needle bar 13, and the middle presser foot 14 is lowered when the needle 12 is lifted up. In addition, the middle presser foot 14 is set so that a slight gap can be formed in a throat plate 16 at a bottom dead point position so as not to interrupt the movement of the cloth C.

In addition, as illustrated in FIG. 2, the sewing machine 100 includes a thread cutting device 43 for cutting a sewing thread when the sewing is completed. The thread cutting device 43 includes: a movable knife (not illustrated) which can reciprocally rotate so as to pass immediately under an eye on a lower side of the throat plate 16; a fixed knife (not illustrated) which cuts the sewing thread by cooperating with the movable knife; a thread cutting motor 431 which reciprocally rotates the moving knife; and a driving circuit 432 which drives the thread cutting motor 431 in accordance with a command from the control device 90.

In addition, in the bed portion 111, on both sides in the X axis direction of the eye (not illustrated) of the throat plate 16, first and second sensors 21 and 22 which serve as detection portions for detecting the relative movement amount in the vicinity of the position of the stitch point of the sewing machine 100 with respect to the cloth C which is manually sent, are respectively provided.

The first and second sensors 21 and 22 are two-dimensional image sensors which are fixedly mounted in a state of facing upward from an upper surface of the throat plate 16.

Furthermore, the first and second sensors 21 and 22 are disposed with optical axes thereof being parallel to the Z axis direction such that the sensors become symmetrical with respect to a plane including a center line of the needle bar 13 and a center line of the middle presser foot rod 141.

The setting ability of both of the sensors 21 and 22 is 3 [μm]. In addition, each of the sensors 21 and 22 detects a lower surface of the cloth C on the throat plate 16 at any time, and inputs the detection data into a processing device 23 provided therewith.

In addition, numerical values of the setting ability of the sensors 21 and 22 are merely examples and are not limited to the above-described numerical value.

The processing device 23 provided to the first and second sensors 21 and 22 monitors a change in movement amount of the cloth C in units of setting ability from the continuous detection data input from each of the sensors 21 and 22 at any time, and counts up the movement amount of cloth C each time the setting ability of 3 [μm] changes.

In addition, when receiving a request for the counted movement amount of cloth C from the control device 90, the processing device 23 inputs the same number of pulse signals as the count value into the control device 90.

After outputting the pulse signal, the processing device 23 resets the count value and counts the movement amount of the cloth C again from 0 until the next request is received from the control device 90.

In addition, the processing device 23 counts the movement amount of the cloth C for each of the first sensor 21 and the second sensor 22, respectively. When detection failure of either one of the sensor 21 or 22 occurs, the processing device inputs a count value based on the detection result by the other one of the sensor 21 or 22 that is normally detected into the control device 90. When both of the sensors normally perform the detection, the processing device inputs a count value based on an average value of the detection result by the sensor 21 or 22 into the control device 90.

Control System of Sewing Machine

The sewing machine 100 includes the control device 90 which performs operation controls of each of the configurations, and the sewing machine motor 30 which is a driving source of a sewing operation and an encoder 31 which detects an output shaft angle (upper shaft angle) thereof are connected to the control device 90 via a driving circuit 32.

In addition, the thread cutting motor 431 of the above-described thread cutting device 43 is connected to the control device 90 via the driving circuit 432, and the above-described first and second sensors 21 and 22 are connected to the control device 90 via the processing device 23.

In addition, an operation panel 41 serving as an operation unit by which an operator of the sewing machine inputs an operation into the sewing machine, a start button 42 for starting the sewing, and a pedal 44 for driving the sewing machine motor 30, are respectively connected to the control device 90 via an interface which is not illustrated.

From the operation panel 41, for example, the stitch pitch which is a length of a seam for each stitch is set. In addition, a display portion is provided on the operation panel 41, and various types of information are displayed.

The control device 90 mainly includes a CPU 91 which performs control of the sewing machine motor 30; a RAM 92 which is a work area of the CPU 91; a ROM 93 in which a program processed by the CPU 91 is stored; and an EEPROM 94 that functions as a storage portion in which data used in arithmetic processing is stored and which is configured to be capable of rewriting the data.

Operation Control during Sewing

Next, sewing operation control performed by the control device 90 of the sewing machine 100 will be described.

As described above, in the sewing machine 100, the sewing is performed while a sewing worker arbitrarily moves the cloth C with respect to the position of the stitch point.

The control device 90 controls the rotation speed of the sewing machine motor 30 so that the sewing is performed while maintaining a constant stitch pitch set from the operation panel 41 when arbitrarily moving the cloth C by the hand of the sewing machine operator.

In addition, in the sewing operation for maintaining the stitch pitch to be constant, the control device 90 executes processing to change the period for obtaining the output of the first and second sensors 21 and 22 with respect to the processing device 23, in accordance with the movement amount of the cloth C per unit time based on the detection result of the first and second sensors 21 and 22.

In other words, when the movement amount of the cloth C per unit time is small, the control device 90 lengthens the period until obtaining the output of each of the sensors 21 and 22 in the next time, and when the movement amount of cloth C per unit time is large, the control device shortens the period until obtaining the output of each of the sensors 21 and 22 in the next time.

In addition, the control device 90 stores table data indicating a relationship between the movement amount of the cloth C and the period until obtaining the outputs of the first and second sensors 21 and 22, in the EEPROM 94. In addition, when obtaining the movement amount of the cloth C per unit time, the control device 90 refers to the table data and determines the period until the output of each of the sensors 21 and 22 is obtained in the next time.

The table data may be data in which a period is defined for each numerical range of a certain movement amount or may be data in which a relationship of a period linearly corresponding to an arbitrary movement amount is defined. Otherwise, the table data may be data in which a function is defined that calculates a constant period for an arbitrary value of a movement amount.

Figure 3:
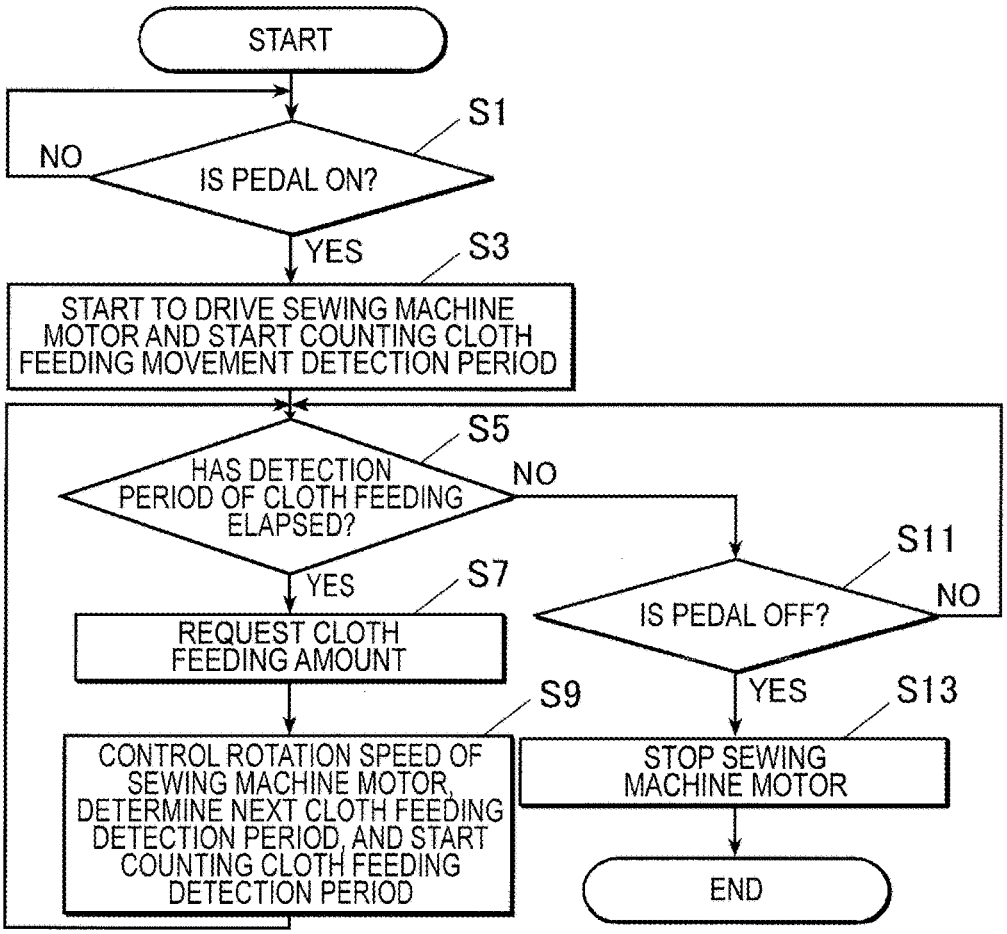
FIG. 3 is a flowchart illustrating processing during sewing by a control device.

FIG. 3 is a flowchart illustrating processing executed by the CPU 91 of the control device 90 during the sewing. Based on this, the processing executed by the CPU 91 during the sewing will be described in detail.

First, the CPU 91 first detects the depression of the pedal 44 (step S1), and when the depression of the pedal 44 is detected, the CPU 91 starts to drive the sewing machine motor 30, and at the same time, starts counting the period until obtaining the outputs of each of the sensors 21 and 22 (step S3). In addition, for initial values of the period until obtaining the outputs of each of the sensors 21 and 22 when driving is started, predetermined values are determined in advance.

In addition, the CPU 91 determines the elapse of one period until obtaining the output of each of the sensors 21 and 22 (step S5).

In addition, when the predetermined period has not elapsed, it is determined whether or not the depression of the pedal 44 has been stopped (step S11), and when the depression is not stopped, the processing returns to step S5. In addition, when the depression of the pedal 44 is stopped, the sewing machine motor 30 is stopped and the sewing is completed.

Meanwhile, in step S5, when it is determined that one predetermined period has elapsed, the CPU 91 requests the processing device 23 for a cloth feeding amount based on the detection result of each of the sensors 21 and 22 (step S7).

Accordingly, the processing device 23 inputs the same number of pulse signals as the count value based on the detection result by each of the sensors 21 and 22 into the control device 90.

Next, the CPU 91 calculates the cloth feeding amount per unit time from the predetermined period and the cloth feeding amount based on the pulse signal. Furthermore, based on the calculated cloth feeding amount, the rotation speed of the sewing machine motor 30 is controlled so that the set stitch pitch is made.

In addition, the CPU 91 refers to the above-described table data based on the calculated cloth feeding amount per unit time, determines the next period until obtaining the outputs of each of the sensors 21 and 22, and starts counting until the next period (step S9).

In addition, the processing returns to step S5, and after repeating the processing of steps S5 to S9, the sewing is completed by turning off the pedal in step S11.

Technical Effect of Embodiment of Invention

The technical effect of the sewing machine 100 will be described with reference to FIGS. 4A and 4B.

As described above, the control device 90 lengthens the period of obtaining the outputs of each of the sensors 21 and 22 as the movement amount of the cloth C per unit time based on the detection result of the first and second sensors 21 and 22 is decreased.

Figure 4A:
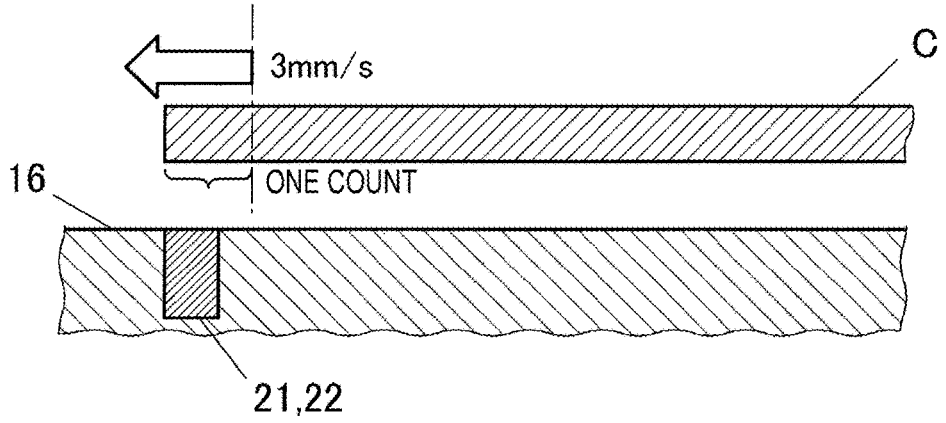
Figure 4B:
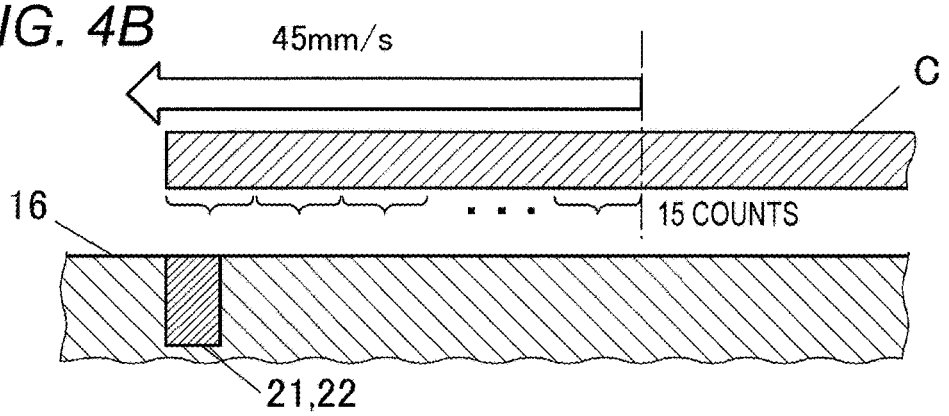

Detection states are illustrated in FIGS. 4A and 4B when the period of obtaining the outputs of each of the sensors 21 and 22 is constant regardless of the movement amount of cloth C per unit time based on the detection result of the first and second sensors 21 and 22.

When the period of obtaining the outputs of each of the sensors 21 and 22 is fixed to 1 [ms], as illustrated in FIG. 4A, in a case were the cloth feeding amount of cloth C per unit time is 3 [mm/s] (low speed), the cloth feeding amount detected in one period is one pulse, that is, one count (3 [μm]).

In addition, as illustrated in FIG. 4B, when the cloth feeding amount per unit time of cloth C is 45 [mm/s] (high speed), the cloth feeding amount detected in one period is 15 pulses, that is, 15 counts (45 [μm]).

As illustrated in FIG. 4A, when the number of pulses of the cloth feeding amount detected in one period is small, and when the noise is included at this time, the influence of the detection error due to the noise becomes very large, and the detection accuracy during the cloth feeding at low speed substantially deteriorates.

Therefore, when the cloth feeding amount is low, it is possible to increase the number of pulses of the cloth feeding amount detected in one period can by lengthening the period for obtaining the output of each of the sensors 21 and 22, and it is possible to improve the detection accuracy at low speed cloth feeding by reducing the influence of noise.

In addition, regardless of the movement amount of the cloth C per unit time based on the detection result by the first and second sensors 21 and 22, it is also considered to fix the period for obtaining the output of each of the sensors 21 and 22 in advance to be a certain period which is relatively longer, but in this case, when the cloth feeding amount is high, the response of the control of the sewing machine motor 30 is delayed, and there is a concern that the followability deteriorates.

Therefore, as the movement amount of the cloth C per unit time based on the detection result of the first and second sensors 21 and 22 increases, the control device 90 shortens the period for obtaining the outputs of each of the sensors 21 and 22 so that it is possible to maintain the followability of the control of the sewing machine motor at a high level while improving the detection accuracy at low speed cloth feeding.

Others

In the above-described sewing machine 100, a case where the cloth C is manually moved with respect to the sewing machine 100 is exemplified, but it is needless to say that the sewing machine 100 may be a sewing machine which performs the free motion sewing by manually moving the sewing machine 100 with respect to the cloth C.

The invention claimed is:

1. A sewing machine comprising:

a detection portion that detects a movement amount of a workpiece;

a sewing machine motor that serves as a driving source for vertical movement of a needle bar; and a control device that controls the sewing machine motor based on the detection result by the detection portion and performs control to maintain a constant stitch pitch, wherein the control device lengthens a period for obtaining an output of the detection portion when the movement amount of the workpiece per unit time based on the detection result by the detection portion is decreased, and shortens the period for obtaining the output of the detection portion when the movement amount of the workpiece per unit time based on the detection result by the detection portion is increased.

2. The sewing machine according to claim 1, wherein free motion sewing is performed by manually moving the workpiece with respect to a position of a stitch point of the sewing machine.

3. The sewing machine according to claim 1, wherein free motion sewing is performed by manually moving the sewing machine with respect to the workpiece.

* * * * *